US006343778B1

(12) United States Patent
Brown

(10) Patent No.: US 6,343,778 B1
(45) Date of Patent: Feb. 5, 2002

(54) ISOTROPICALLY ARTICULATING FENCE SYSTEM

(76) Inventor: Donald C. Brown, 10092 Colorado Rd. #36, Yuma, CO (US) 80759

( * ) Notice: Subject to any disclaimer, the term of this patent is extended or adjusted under 35 U.S.C. 154(b) by 0 days.

(21) Appl. No.: 09/399,126

(22) Filed: Sep. 20, 1999

(51) Int. Cl.[7] ..... E04H 17/02

(52) U.S. Cl. ..... 256/32; 256/40; 256/DIG. 2; 256/10

(58) Field of Search ..... 256/32, 37, 39, 256/40, 14, 12.5, 13.1, 1, DIG. 1, DIG. 2, 47, 2, 10; 403/229; 248/622, 623, 160; 52/113

(56) References Cited

U.S. PATENT DOCUMENTS

| | | | | | |
|---|---|---|---|---|---|
| 361,223 | A | * | 4/1887 | Kelly | 256/47 X |
| 413,088 | A | | 10/1889 | Payne | |
| 423,809 | A | | 3/1890 | Price | |
| 446,852 | A | | 2/1891 | Davis | |
| 567,333 | A | | 9/1896 | Chandler | |
| 810,260 | A | | 1/1906 | Bugby | |
| 935,522 | A | | 9/1909 | King | |
| 1,293,612 | A | | 2/1919 | Magley | |
| 1,857,435 | A | * | 5/1932 | Cole | 256/13.1 |
| 1,877,074 | A | * | 9/1932 | Stanziale | 256/13.1 X |
| 2,204,556 | A | * | 6/1940 | Ahles | 256/13.1 |
| 2,949,324 | A | * | 8/1960 | Birge et al. | 256/13.1 X |
| 3,717,326 | A | * | 2/1973 | Leach et al. | 256/13.1 |
| 4,032,248 | A | | 6/1977 | Parduhn | |
| 4,106,879 | A | * | 8/1978 | Diedershagen et al. | 256/1 X |
| 4,196,890 | A | * | 4/1980 | Einhorn | 256/2 |
| 4,240,766 | A | * | 12/1980 | Smith et al. | 256/13.1 X |
| 4,535,974 | A | * | 8/1985 | Conde | 256/1 |
| 4,605,204 | A | * | 8/1986 | Schmanski et al. | 256/19 |
| 4,819,915 | A | * | 4/1989 | Cargnel | 256/12.5 |
| 5,186,119 | A | * | 2/1993 | Hlavin | 116/222 |
| 5,299,781 | A | * | 4/1994 | Barrett et al. | 256/12.5 |

FOREIGN PATENT DOCUMENTS

| | | | | |
|---|---|---|---|---|
| CH | 662624 | * | 10/1987 | 256/DIG. 1 |
| IT | 580285 | * | 7/1958 | 256/12.5 |

* cited by examiner

*Primary Examiner*—Harry C. Kim
(74) *Attorney, Agent, or Firm*—Rader, Fishman & Grauer PLLC; Lee G. Meyer

(57) ABSTRACT

A fencing system which can resiliently articulate from an upright position, perpendicular to the ground, to a flattened position, parallel with the ground, is described. The fence system comprises at least two fence posts, where at least one fence post is a resiliently articulating fence post, and where the posts are connected by strands of fencing material such as barbed wire. The strands of fencing material are kept taut across the fence system by a tensioning system. The articulating fence posts include a shaft that supports the strands of fencing material, and an isotropically flexible member which is attached to the bottom end of the shaft. The fence system of the present invention avoids damage from a collision between farm equipment, such as a mobile irrigation system, and the fence by having the fence resiliently articulate, from an upright position to the ground, in order to allow the mobile equipment to run over the fence without breaking fence posts or snapping strands of fencing material. Once the equipment completely rolls over the vehicle, the fence system automatically returns to its upright position.

25 Claims, 2 Drawing Sheets

ISOTROPICALLY ARTICULATING FENCE SYSTEM

BACKGROUND OF THE INVENTION

1. Field of the Invention

The present invention relates to articulating fencing systems and, more particularly, to a radially articulating fencing system.

2. Description of the Related Art

Farmers and ranchers use fences, walls, hedgerows and other boundary markers to demarcate territory, and to control ingress and egress of persons and animals from and to the boundaries territory. With the advent of large cattle and sheep ranches, particularly in the Western United States, fences are used primarily to restrain domestic livestock from leaving a fenced in area. These western style fences are typically built from four or five horizontally spaced strands of barbed wire, mounted on wooden fence posts that are driven into the ground. A single fence, often stretching for miles, is used to delineate a "range" or "pasture" where herds of cattle, or other grazing animals, are confined.

Multi-purpose land use methods have brought crop cultivation and the raising of livestock together on the same land. These multi-use methods involve dividing a tract of land into several parcels and rotating the function of the parcels between crop cultivation and livestock feeding. These methods typically involve concentrating dense populations of livestock, such as feeder cattle and dairy cattle, on one parcel while crops, such as grains and seeds, are being cultivated on the others. Since cattle fed in this manner are in high density, barbed wire fences, and fences that have electrified strands of wire, are needed to confine the cattle in the parcel. Multi-purpose land use methods have gained widespread acceptance in the agriculture business because they generate increased yields of table meat from cattle by providing abundant food supplies for fattening cattle prior to slaughter.

With the requirement for increased agriculture production, especially in arid climes, sophisticated irrigation systems and methods have become a necessity to increase acreage yields. Today, these systems are usually automated, using computers, and can cover extended acreage without being manned. Water pressure and electricity are commonly used to provide the energy to move these systems. The irrigation systems which have mechanized means of movement such as drive wheels mounted under spray irrigation carriages. A pivotal irrigation system, for example, is anchored at a center point and rotates about that point on large cleated wheels, mounted under a spray irrigation carriage, to sweep out an irrigation circle which can be a mile or more in diameter.

The close proximity of cattle pastures and domestic crops created by modern, multi-purpose land use methods have put an unforseen burden on irrigation systems. The fences, necessary for separating cattle pastures from growing crops, greatly hinder the mobility of irrigation systems over a tract of multi purpose farmland. Large irrigation systems designed to efficiently irrigate large tracts of land, such as a pivotal irrigation systems, become impractical if they are obstructed by fences.

One approach to allow a fenced area to be irrigated, has been to place gaps in the fence which are wide enough for the cleated wheels of the irrigation system to pass. Unfortunately, the cleated wheels are so wide that the gaps in the fence are large enough to let livestock, including cattle, pass as well.

Another approach is to have crews move the fence in the path of the irrigation system and then replace it. This is labor intensive and expensive. It would therefore be advantageous to have fencing system that could articulate under the force of the moving irrigation system wheels, yet be resilient enough to retain livestock. Unfortunately, there are a number of problems associated with such a system. First, the fence must be able to yield to the force of the cleated wheels and articulate from its upright position, perpendicular to the ground, to a substantially flattened position that is parallel with the ground. Second, the fence system must maintain the strand integrity to keep from snapping wire strands as the fence articulates.

Articulating fence systems have been suggested for varying uses, such as flood-fences built along river banks that are prone to regular flooding. U.S. Pat. No. 567,333 issued to Chandler, for example, discloses fence posts and fences that can pivot on a hinge from an upright position normal to the ground, to a flattened position parallel with the ground. Unfortunately, a number of problems arise when attempts are made to adapt these fence systems to use with mobile irrigation systems on farmland.

Many hinged fence systems disclosed in the prior art are designed to remain parallel with the ground after being knocked down, and must be re-erected by hand to their upright positions. Such systems defeat the benefit of having a computer-controlled, self-propelled irrigation system, since they must be monitored and re-erected. Moreover, fences which are down for even a short time create a possibility that livestock will migrate from their designated pastures. In addition, they are labor intensive and thus expensive.

There are additional problems with fence systems disclosed in the prior art. Those that have some kind of resilient means, such as a spring mechanism, which allow the fence to spring back to an upright position after being knocked down by the irrigation system, are hinged at their base so as only to pivot in a single plane. If an irrigation system does not approach the fence in a direction that is perfectly aligned with the articulation direction of the fence system, then the irrigation system imparts side loads on the fence and can cause permanent damage to both systems. This problem is particularly acute for the widely used irrigation systems that rotate around a fixed center point. These systems commonly exert side load forces on the fence, causing either the posts or the wire strand to break or to be damaged.

Presently, there is a need for an articulating fencing system that can allow passage of the irrigation system and accommodate the side loads exerted on the fence by the irrigation system. This need is especially great for fence systems which have delicate strands of electrified fencing wire which are easily snapped under the strain of an impinging irrigation system that moves along an arc that is not perpendicular to the fence line.

SUMMARY OF THE INVENTION

It has now been discovered that the problems encountered with prior art fencing systems can be overcome by the present invention. In the broad aspect of the present invention, a fencing system is provided that comprises at least two fence posts, wherein at least one of the fence posts is a resilient, isotropically articulating member, and the posts have strung there between at least one strand of flexible fencing material, such as a wire or cord. In accordance with the present invention, the system resiliently yields to forces exerted in substantially all directions, including directions other than those perpendicular to the fence line.

In accordance with the broad aspect of the present invention, the fencing system contains at least one isotropic fence post that resiliently yields to an object (e.g., a mobile irrigation system) approaching the fencing system from any direction, even a direction substantially parallel to the fence line. The fencing system yields to objects resistively. For example, the system will resiliently yield to a mobile irrigation system, but not to the force of a cow moving against the fence. In a preferred aspect, the resistance to a force pressing against the fence system is variably set, causing the fence posts to substantially yield only when a preset amount of force is applied. For example, the resistance can be set such that the force of a strong wind or a herd of cows will not cause the fence posts to articulate, but the force of an impinging irrigation system will.

Preferably, the fence system of the present invention has at least three posts, including at least one resiliently articulating center post that is aligned between a pair of end posts, wherein a flexible fencing material is strung between adjoining posts. The at least one center post of the present invention is a resilient, isotropically articulating member that preferably includes a shaft adapted for affixing flexible fencing material; a resilient, isotropically flexible member having a top end for rigid communication with the shaft and a bottom end for rigid communication with a base element; and an anchor element, connected to the base element, for anchoring the base. The flexible fencing material preferably comprises strands of wire, either single strand or braided, including strands of electrically conducting metal for electric fences, and strands of barbed wire.

The end post elements of the system of the instant invention can be resiliently articulating, or they can be rigid, non-articulating supports. In a preferred aspect, the end posts are non-articulating. It will be realized that in accordance with the invention the end post elements may also form the apex of a corner that is formed from two linear segments of fence which are joined together at an angle (i.e., the end post is a corner post). At least one segment so joined is radially articulating.

In accordance with a preferred aspect of the present invention, the resilient, isotropically articulating posts have an isotropically flexible member for allowing a shaft to resiliently articulate between a position substantially perpendicular to the ground, and a position substantially parallel to the ground. In a preferred embodiment, the isotropically articulating member is a spring, and preferably a coil spring, that is able of radial, resilient articulation. In another embodiment, the isotropically flexible member is a segment of flexible hose, preferably made from plastic or rubber.

Preferably, a fence material tensioning means, such as a coil spring, is used to attach a strand of fencing material to at least one post element of the fencing system. The tensioning means provides flexibility to assure the integrity of the fence material when the fence is under stress. This is to further assure that strands of fencing material in the fencing system will not break when the fence posts are articulated.

In one preferred embodiment, the tensioning means includes at least one spring element connected at one end to a strand of fencing material and on the other to a variable set tensioning means, such as a turnbuckle, which adjusts the amount of tension on the strand. In another embodiment, the tensioning means comprises two spring segments having a variable set tensioning means there between. In another embodiment, the tensioning means comprises a spring loaded pulley assembly rotatably attached to the end post assembly. A strand of fencing material is spooled on the pulley and held in tensioned engagement therewith.

BRIEF DESCRIPTION OF THE DRAWINGS

The objects, features and advantages of the present invention will be apparent to one skilled in the art, in view of the following detailed description in which.

DEFINITIONS OF NOMENCLATURE

The term "isotropically," defined in the context of "isotropically articulating fence system," "isotropically articulating post," and "isotropically flexible member," means that the member can articulate in any direction about an axis flush with and parallel to the ground. Thus, the member can articulate in any direction from an upright position, substantially perpendicular to the ground, to a flattened position, substantially parallel with the ground. The articulated motion of the member inscribes a circle on the ground whose radius is equal to the height of the member measured from the ground.

The term "resilient," defined in the context of a "resilient fence post member", or "resilient fence system", means that a flattened articulating member has a memory such that in the presence of zero loading, the member will return from an articulated position to its upright position which is substantially perpendicular to the ground. In addition, the term resilient, as used herein, is meant to imply a resistance to articulation sufficient to resist cattle or other confined livestock from straying outside the boundaries of the fencing system.

DETAILED DESCRIPTION OF THE INVENTION

Figure 1:
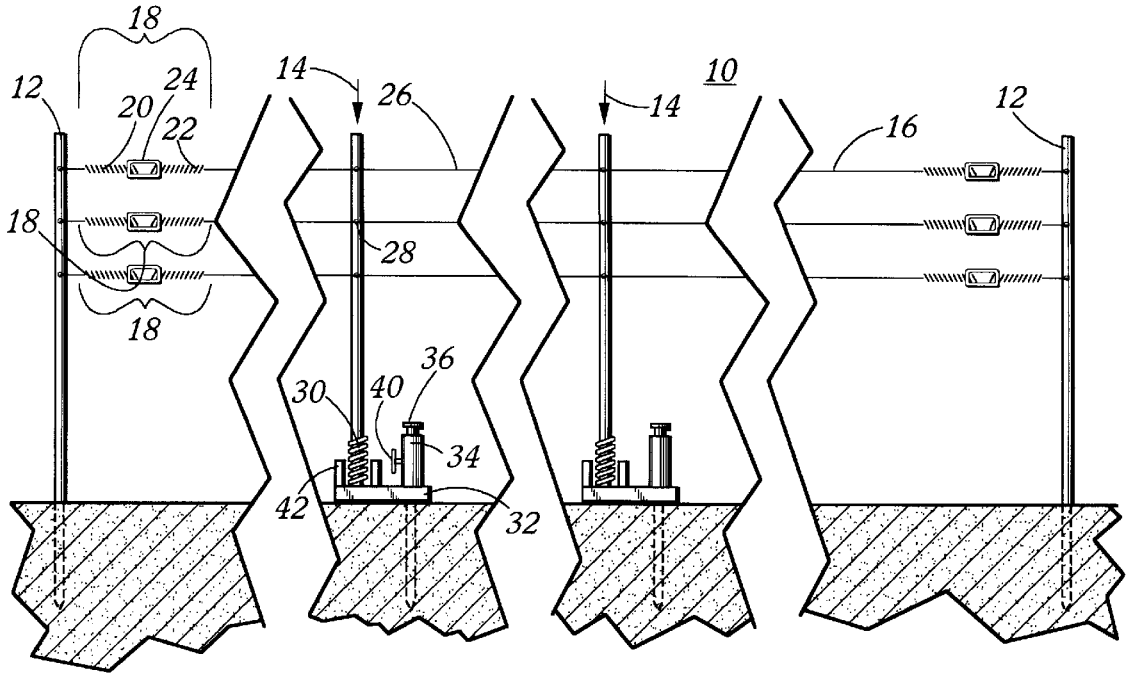
FIG. 1 is a segmented illustration of the resilient, articulating fencing system of the instant invention.

Referring now to FIG. 1, there is shown the fencing system 10 of the instant invention having two end posts 12 and two resiliently radially articulating center posts 14. Three strands of fencing material 16 are strung there between. The fencing material may be made from material comprising flexible cord polytape, smooth wire or barbed wire. FIG. 1 has been segmented for illustration purposes only, to allow the depiction of a fencing system in a single drawing. In accordance with the illustrated preferred embodiment of the fencing system of the instant invention shown in FIG. 1, two end posts 12 are arranged collinearly between aligned, resiliently radially articulating center posts 14. Each end post 12 is attached to a tensioning means 18 which is in turn attached to the strands 16. The tensioning means 18, which provides slack to the strands of fencing material 16 when the resiliently radially articulating center posts 14 articulate, comprises a first spring segment 20 and a second spring segment 22 which are connected at their respective ends by turnbuckle 24. The first spring segment 20 is attached on its other end to the end posts 12 at tensioning means 18, and the second spring segment 22 is attached at its other end to the strands of fencing material 16. The amount of tension on the strands of fencing material 16 can be adjusted by tightening or loosening the slack in the strands of fencing material 16 by means of turnbuckles 24.

Figure 2:
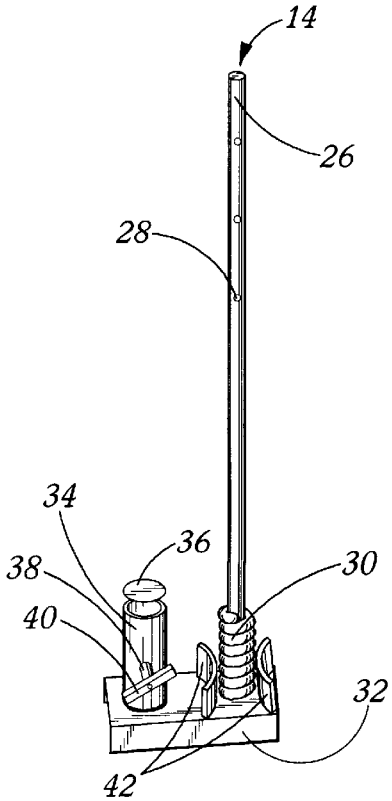
FIG. 2 is a detailed illustration of a resiliently, radially articulating post element of the instant invention.

As better shown in FIG. 2, the resiliently articulating fence post 14 is comprised of a shaft 26 having at least one aperture 28 adapted to receive strands of fencing material 16. The shaft may be made from materials such as metal, wood, plastic or fiberglass. The lower end of shaft 26 is affixed to spring 30, which allows the shaft 26 to articulate from normally upright positions to positions parallel with the ground. The spring 30 is resilient, so once the force is removed that holds the shaft 26 parallel with the ground, the shaft 26 and spring 30 automatically return to an upright position, substantially perpendicular to the ground.

The lower end of the spring 30 is attached to the top side of the base 32. The base 32 includes hollow tube 34 which accepts stake 36 that is driven into the ground in order to immovably anchor the fencing system 10 to the ground. A threaded aperture (not shown), formed in the side of tube 34, accepts a threaded shaft 38, attached to an actuator handle 40. The threaded shaft 38 is tightened to engage stake 36 with the actuator handle 40, in order to immovably fix the stake 36 to the base 32. In another embodiment (not shown) base 32 is outfitted with a one way jaw means for automatically engaging stake 36 to hold the base 32 to engaging stake 36. A pair of rigid collars 42 are formed on the base 32 between the spring 30. The rigid collars 42 act to guide the direction of the shaft 26 as it articulates up and down between an upright position and the ground.

Fence system 10 will articulate to allow passage of the desired device e.g. an irrigation device, when an external force of sufficient magnitude is exerted on the fence system 10. In operation, the resiliently radially articulating center posts 14 articulate towards the ground from their normally upright positions. The strain placed on the fencing material 16 when the shafts 26 articulate towards the ground is reduced by stretching the length of the first and second spring segments, 20 and 22, thus providing slack to the fencing material 16. When the external force is removed, the resilient shaft 26 articulates back to its fully upright positions, and the first and second springs, 20 and 22, contract to remove the slack in the fencing material 16, keeping the fencing material 16 taut.

Figure 3:
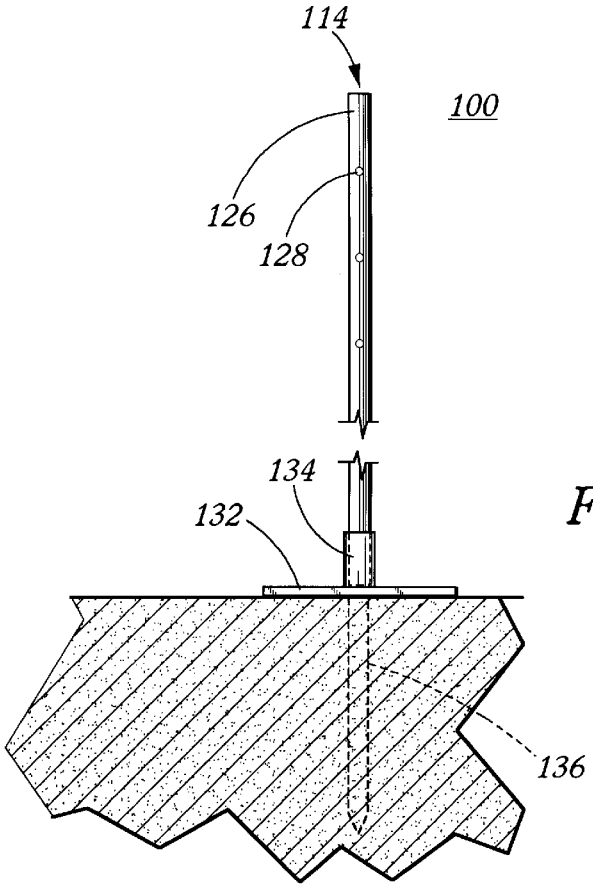
FIG. 3 is an illustration of another embodiment of a resiliently, radially articulating post having a segment of flexible tubing.

Referring now to FIG. 3, another preferred aspect of the resiliently radially articulating center posts 114 of the fencing system 100 is shown. In this preferred aspect, the bottom end of the shaft 126 is inserted into the isotropically flexible member 134 which comprises a segment of resilient, isotropically flexible tubing. The shaft 126 is normally positioned upright in tubing 134, and can radially articulate from this upright position to a substantially flattened position proximate the ground. Since the tubing 134 is resilient, the shaft 126 will automatically return to an upright position when the articulating force is removed.

The lower end of the tubing 126 is attached to the top side of the base 132. The base 132 is immovably anchored to the ground by a stake 136, attached to the bottom of the base 132. The stake 136 may be formed with fins (not shown), so called a T-Post, which make the stake easy to drive into the ground, but difficult to extract from the ground. The shaft 126 has at least one aperture 128 which can accept strands of fencing material (not shown). Three apertures 128 are located proximate to the top end of the shaft 126, and each aperture 128 runs through the shaft 126 perpendicular to the long axis of the shaft 126. The apertures 128 are adapted to allow the fencing strand material (not shown) to pass there through.

Figure 4:
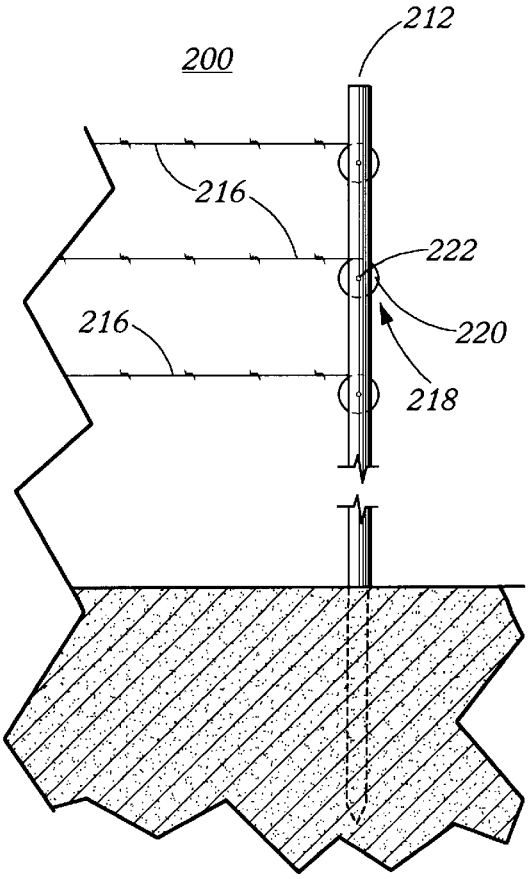
FIG. 4 is a cutaway illustration of another embodiment of the end post of the instant invention having spring loaded pulleys for resiliently tethering the fence strands.

Referring now to FIG. 4, another embodiment of an end post 212 of the instant invention is shown. This end post 212 is inserted directly into the ground, and stands unyieldingly upright in the ground. A tensioning means 218 comprising a collinear series of rotatable, spring loaded pulleys 220 are rotatably secured through their center to the end post 212 by means of fasteners 222, such as, pins, bolts or screws. Fencing material 216 is fixedly attached to the pulleys 220 and spooled thereon such that the spring loaded pulley tensions the fencing material. When the strands of fencing material 216 come under stress as resiliently articulating center posts (not shown) flex towards the ground, the pulleys 220 play additional fencing material 216 to reduce the strain. When the resilient articulating center posts (not shown) return to their upright position, the pulleys 220 automatically "reel" in the slack in the fencing material 216, keeping the strands of fencing material 216 taut along the length of the fence system 200.

The flexible fence system of the present invention has been exemplified with reference to the various aspects and examples described and illustrated above. By using the description of the present invention found herein, one skilled in the art may be able to design other versions of the flexible fence system, and its component parts, which differ from those illustrated. However, the present invention is not intended to be limited to only the described aspects and examples. Rather, the following claims, and all equivalents of these claims, define the scope of the present invention.

What is claimed is:

1. A resiliently rotationally articulating fencing system comprising at least two fence posts and at least one strand of fencing material strung between said fence posts, wherein at least one of said fence posts is a rotationally resiliently articulating fence post adapted to yield to a preset force by resiliently, rotationally articulating upon application of said force from a substantially upright position perpendicular to the ground to a position substantially parallel with the ground wherein said resiliently rotationally articulating fence post comprises:

a rigid linear member adapted for affixing said at least one strand of fencing material;

a resilient, isotropically flexible member, adopted to yield to a preset force, having a top end for rigid communication with the rigid linear member and a bottom end wherein said resilient, isotropically flexible member is able to rotationally articulate upon application of said preset force such that said at least one fence post is capable of rotational rotation from a substantially upright position perpendicular to the ground to a position substantially parallel with the ground;

a base attached to the bottom end of the resilient isotropically flexible member; and an anchor means, connected to the base, to allow the base to be immovably attached or fixed to the ground wherein said fencing material is selected from the group comprising barbed wire, smooth wire, and wire for electrification.

2. The fencing system of claim 1, wherein said fencing system further comprises a means for electrifying the at least one strand of said fencing material.

3. A resiliently rotationally articulating fencing system comprising at least two fence posts and at least one strand of fencing material strung between said fence posts, wherein at least one of said fence posts is a rotationally resiliently articulating fence post adapted to yield to a preset force by resiliently, rotationally articulating upon application of said force from a substantially upright position perpendicular to the ground to a position substantially parallel with the ground wherein said resiliently rotationally articulating fence post comprises:

a rigid linear member adapted for affixing said at least one strand of fencing material;

a resilient, isotropically flexible member, adopted to yield to a preset force, having a top end for rigid communication with the rigid linear member and a bottom end wherein said resilient, isotropically flexible member is able to rotationally articulate upon application of said preset force such that said at least one fence post is capable of rotational rotation from a substantially upright position perpendicular to the ground to a position substantially parallel with the ground;

a base attached to the bottom end of the resilient isotropically flexible member; and an anchor means, connected to the base, to allow the base to be immovably attached or fixed to the ground; and a tensioning means for maintaining the at least one strand of fencing material taut when the at least one resiliently articulating fence post is substantially upright and when the resiliently articulating fence post is substantially parallel with the ground.

4. The fence system of claim 3, wherein said tensioning means comprises:

at least one spring having a first section and a second section, wherein the first section is attached to said fence post and the second section is attached to the fencing material; and a turnbuckle for adjusting the tension on the spring;

said turnbuckle having a first end and a second end opposite the first end, wherein the first end of the turnbuckle is attached to the first section of the spring and the second end of the turnbuckle is attached to the second section of the spring.

5. The fencing system of claim 3, wherein said tensioning means comprises:

at least one tensioned pulley fastened to said fence post, wherein said pulley is attached to the fencing material, to keep the fencing material taut.

6. The fencing system of claim 3, wherein said at least one resiliently articulating fence post further comprises a pair of guide walls, attached to the base and positioned between the resilient, isotropically flexible member, for guiding the direction in which said resiliently articulating fence post articulates.

7. The fencing system of claim 3, wherein said rigid linear member comprises a rigid rod made of material selected from the group consisting of metal, wood, plastic and fiberglass.

8. The fencing system of claim 3, wherein said resilient, isotropically flexible member is selected from the group consisting of a spring and a flexible hose segment.

9. The fencing system of claim 3,wherein said anchor means comprises:

a hollow tube orientated approximately normal to the ground;

a stake, slidably insertable inside the hollow tube, to anchor the base of the fence post to the ground; and a fixing means, attached to the hollow tube, for reversibly fixing the position of the stake inside the hollow tube.

10. The fencing system of claim 3, wherein said anchor means comprises:

a pointed shaft, having an upper end and a lower end, wherein the upper end is attached to a bottom side of the base and the lower end is pointed to allow the shaft to be driven into the ground to anchor the fence post.

11. The fencing system of claim 3, wherein said fencing system further comprises a means for electrifying the at least one strand of said fencing material.

12. The fencing system of claim 3, wherein said fencing material comprises flexiblecord polytape or smooth wire.

13. A resiliently articulating fencing system comprising at least three fence posts and at least one strand of fencing material selected from the group comprising barbed wire, smooth wire, and wire for electrification, retained between said fence posts, wherein said at least three fence posts include a pair of end fence posts, and at least one center fence post aligned between said end fence posts, wherein said at least one center fence post has:

a rigid linear member adapted for affixing at least one strand of fencing material;

a resilient, isotropically flexible member, adopted to yield to a preset force, having a top end for rigid communication with the rigid linear member and a bottom end wherein said resilient, isotropically flexible member is able to rotationally articulate upon application of said preset force such that said at least one fence post is capable of rotational rotation from a substantially upright position perpendicular to the ground to a position substantially parallel with the ground; having a top end for rigid communication with the rigid linear member and a bottom end wherein said resilient, isotropically flexible member is able to rotationally articulate such that said center fence post is capable of rotational rotation from a substantially upright position perpendicular to the ground to a position substantially parallel with the ground;

a base attached to the bottom end of the isotropically flexible member; and an anchor means, connected to the base, to allow the base to be immovably attached to the ground.

14. The fencing system of claim 13, wherein said end fence posts are resiliently articulating fence posts.

15. The fencing system of claim 13, wherein said end fence posts are non-articulating, and are rigidly anchored to the ground.

16. The fencing system of claim 13, wherein said fencing system further comprises a tensioning means, attached to said at least one strand of fencing material and attached to at least one of the end fence posts, for keeping the fencing material taut when the at least one center fence post is substantially upright and when the at least one center fence post is substantially parallel with the ground.

17. A resiliently rotationally articulating fencing system comprising at least two fence posts and at least one strand of fencing material strung between said fence posts, wherein at least one of said fence posts is a resiliently articulating post which has:

a rigid linear member adapted for affixing at least one strand of fencing material;

a resilient, isotropically flexible member having a top end for rigid communication with the rigid linear member and a bottom end;

a base attached to the bottom end of the member;

an anchor means, connected to the base, to allow the base to be immovably attached or fixed to the ground; and, a tensioning means for keeping the at least one strand of fencing material taut when the at least one resiliently articulating fence post is substantially upright and when the post is substantially parallel with the ground.

18. The fence system of claim 17, wherein said tensioning means comprises:

at least one spring having a first section and a second section, wherein the first section is attached to said fence post and the second section is attached to the fence material; and a turnbuckle for adjusting the tension on the spring;

said turnbuckle having a first end and a second end opposite the first end, wherein the first end of the turnbuckle is attached to the first section of the spring and the second end of the turnbuckle is attached to the second section of the spring.

19. The fencing system of claim 17, wherein said tensioning means comprises:

at least one tensioned pulley fastened to said fence post, wherein said pulley is attached to the fencing material, to keep the fencing material taut.

20. The fencing system of claim 17, wherein said at least one resiliently articulating fence post isotropcially articulates between an upright position, substantially perpendicular to the ground, and a flattened position, substantially parallel with the ground.

21. The fencing system of claim 17, wherein said fencing system further comprises a means for electrifying the at least one strand of fencing material.

22. The fencing system of claim 17, wherein said fencing material comprises flexible cord polytape or smooth wire.

23. The fencing system of claim 17, wherein said strands of fencing material is barbed wire.

24. A resiliently articulating fence post comprising:

a rigid linear member adapted for affixing at least one strand of fencing material;

a resilient, isotropically flexible member having a top end for rigid communication with the rigid linear member;

a base, attached to a bottom end of the isotropically flexible member; and an anchor means, connected to the base, to allow the base to be immovably fixed to the ground wherein said fence post further comprises a pair of guide walls, attached to the base and positioned such that the flexible member is disposed there between, to control the bending direction of said fence post.

25. A resiliently articulating fence post comprising:

a rigid linear member adapted for affixing at least one strand of fencing material;

a resilient, isotropically flexible member having a top end for rigid communication with the rigid linear member;

a base, attached to a bottom end of the isotropically flexible member; and an anchor means, connected to the base, to allow the base to be immovably fixed to the ground wherein said anchor means comprises:

a hollow tube orientated approximately normal to the ground;

a stake, slidably insertable inside the hollow tube, to anchor the base of the fence post to the ground; and a fixing means, attached to the hollow tube, for reversibly fixing the position of the stake inside the hollow tube.

* * * * *